United States Patent [19]

Sartain et al.

[11] Patent Number: 4,459,711

[45] Date of Patent: Jul. 17, 1984

[54] SWIMMING POOL COVER ASSEMBLY

[75] Inventors: Donald W. Sartain, 36 Mobile La., Ventura, Calif. 93001; Lee C. Paxton; Melvin R. Kastl, both of Carmichael, Calif.

[73] Assignee: Donald W. Sartain, Ventura, Calif.

[21] Appl. No.: 449,556

[22] Filed: Dec. 13, 1982

[51] Int. Cl.[3] ..... E04H 3/19

[52] U.S. Cl. ..... 4/502; 4/503; 4/498

[58] Field of Search ..... 4/502, 499, 498, 500, 4/503, 504, 505

[56] References Cited

U.S. PATENT DOCUMENTS

| | | | |
|---|---|---|---|
| 2,754,899 | 7/1956 | Karobonik et al. | 4/502 X |
| 3,050,743 | 8/1962 | Lamb | 4/502 |
| 3,574,979 | 4/1971 | Chan | 4/499 |
| 3,613,126 | 10/1971 | Granderath | 4/502 |
| 3,747,132 | 7/1973 | Foster | 4/502 |
| 3,777,319 | 12/1973 | Myles | 4/502 |
| 3,982,286 | 9/1976 | Foster | 4/502 |
| 4,060,860 | 12/1977 | Lamb | 4/502 |
| 4,351,072 | 9/1982 | Smith | 4/502 X |

FOREIGN PATENT DOCUMENTS

| | | | |
|---|---|---|---|
| 2938496 | 4/1980 | Netherlands | 4/502 |

*Primary Examiner*—Henry K. Artis

*Attorney, Agent, or Firm*—Gene W. Arant

[57] ABSTRACT

A swimming pool cover assembly is adapted to be operated by hand by a single person, for extending a cover sheet over a swimming pool or for retracting the cover. The cover sheet is wound upon a drum at one end of the pool, while a rope is wound upon a spool located at one end of the drum. A hand crank or electric motor is used either to drivingly rotate the spool to take up the rope, or to drivingly rotate the drum to take up the cover. The rope is positioned in a tensioned loop configuration with its remote end being connected to the forward end of the cover sheet, and is supported on pulleys removably secured to the pool decking. The hand crank or motor drives either the spool or the drum through a gear mechanism, being automatically switched from one to the other depending upon the direction of rotation of the hand crank. Side fasteners secured along the side edges and free end of the cover sheet are removably attached to anchors on the pool decking when the cover is in its extended position.

2 Claims, 9 Drawing Figures

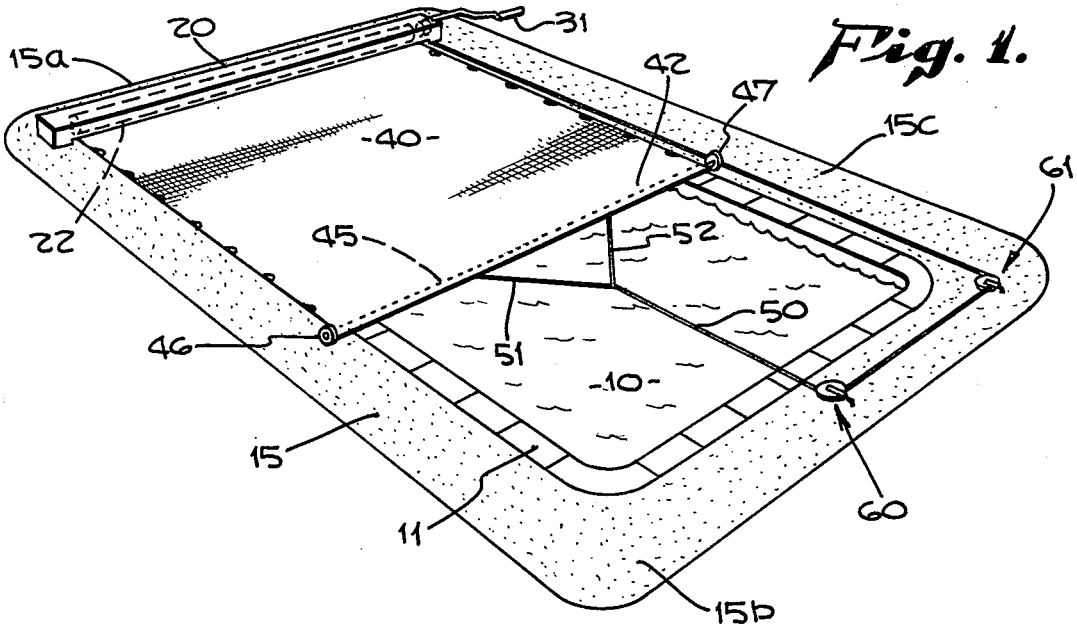
Fig. 1.
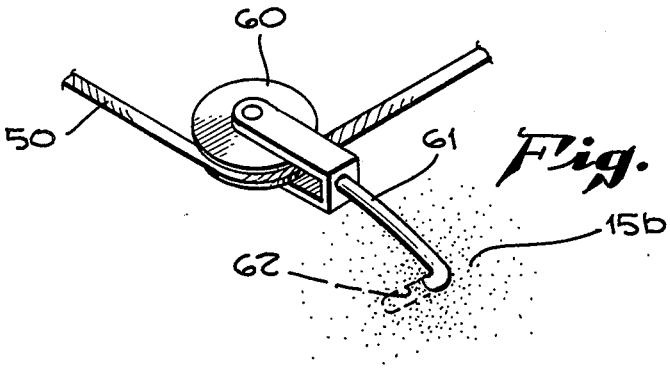
Fig. 2.
Fig. 7.
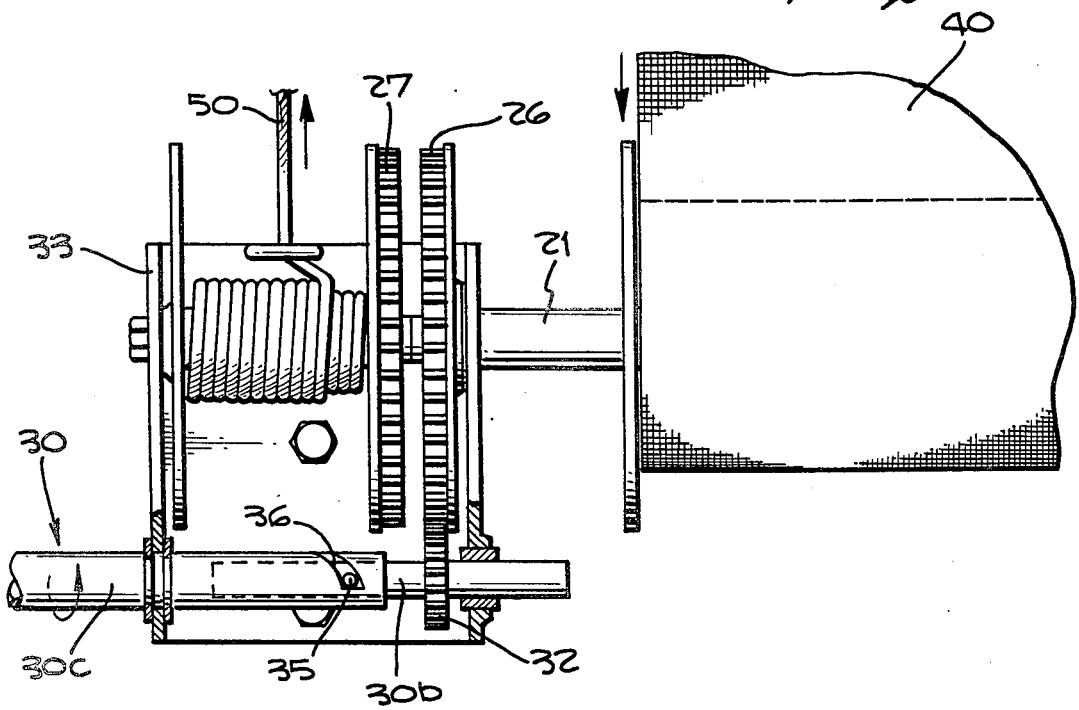

6
6
21
22
23
24
26
27
30
30a
30b
30c
31
32
33
35
36
40
50

SWIMMING POOL COVER ASSEMBLY

BACKGROUND OF THE INVENTION

Covering a swimming pool is desirable not only to protect the pool from having dirt and leaves fall into the water, from excessive loss of water by evaporation, and from loss of heat through evaporation, but also as a safety measure to prevent persons such as small children from accidentally falling into the pool.

Swimming pools normally have a minimum length of at least 30 feet and a minimum width of at least 12 feet, hence any swimming pool cover is necessarily a bulky thing. Because of this problem some pool owners simply leave their swimming pool uncovered all year round. Others build a permanent house over and around the pool. Still others employ some type of removable swimming pool cover. The present invention relates to a swimming pool cover that is removable.

A number of different types of removable pool covers have been previously known and used. Some are electrically operated for extending or removing the cover. Hydraulic actuation has also been used for positioning a removable pool cover. Still other covers have been put on or taken off by hand, and it is believed that this has always required two persons.

PRIOR ART

U.S. Pat. No. 3,277,498 shows a removable pool cover for a rectangular swimming pool. The cover is extended with the aid of tracks along the sides of the pool. The extension and retraction of the cover is controlled by means of an electric motor drive.

SUMMARY OF THE INVENTION

According to the present invention a removable swimming pool cover is provided, which can easily be put in place or removed by one person acting alone.

According to the present invention a cover sheet is normally wound upon a drum that is located at one end of the pool. A rope is connected to the free end of the cover sheet, with the other end of the rope being brought back to a spool that is located adjacent one end of the drum. Two pulleys are positioned at the far end of the pool, one being in the lateral center of the pool and the other being at the corner of the pool on the same side where the spool is located. The rope extends around these two pulleys so that the rope and cover sheet together form a tensioned loop.

A reversible drive shaft is operated by an electric motor or by a hand crank. The reversible drive shaft is coupled both to the drum that carries the cover sheet, and to the spool that carries the rope. A camming mechanism incorporated as part of the drive shaft assembly causes it to change its connection or engagement depending upon the direction of rotation. That is, rotation of the hand crank or motor in one direction causes the rope spool to be driven so as to take up the rope and thereby extend the cover sheet, while rotation of the hand crank or motor in the opposite direction causes the drum to be driven so as to take up the cover sheet and hence retract it from the pool.

The pulleys that normally support the rope in its tensioned loop configuration are removably attached to the pool decking. Therefore, when the cover sheet is fully retracted and the pool is to be used for swimming, the two pulleys are detached from the pool decking and the rope and pulleys are moved out of the way.

Another novel feature of the invention is the use of detachable fasteners for securing the sides of the cover to the pool decking, when the cover is in extended position. The side fasteners are permanently attached to the cover sheet, and when the pool cover is in extended position they are removably secured to anchor means on the surface of the pool deck.

DRAWING SUMMARY

FIG. 1 is a perspective view of a swimming pool partially covered by our novel cover assembly;

FIG. 2 is a fragmentary perspective view showing the removable corner pulley;

FIG. 7 is a view like FIG. 4 but showing the cover being retracted from the pool;

DETAILED DESCRIPTION

(First Embodiment)

Figure 3:
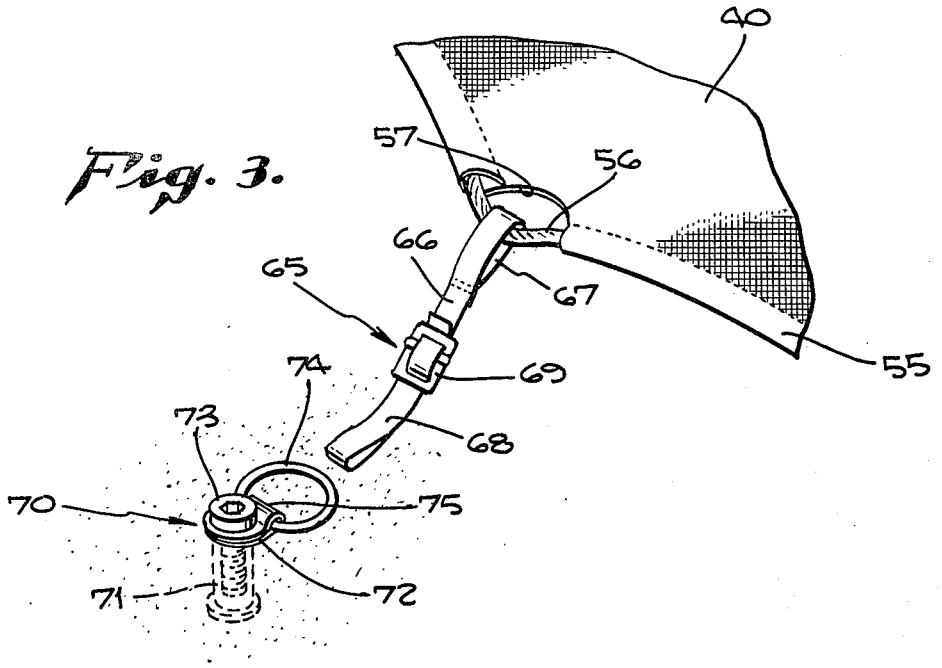
FIG. 3 is a fragmentary perspective view showing one of the side fasteners and its associated anchor.

Reference is now made to FIGS. 1 through 8 of the drawings which illustrate a complete embodiment of the invention.

As shown in FIG. 1 a pool 10 is surrounded by tile 11, which is in turn surrounded by concrete decking 15. At the far end of the pool a cover housing 20 rests upon the decking 15*a*. The decking on the near end of the pool as shown in FIG. 1 is designated as 15*b*, while the decking on one side is designated by numeral 15*c*.

Figures 4, 5, 6, 8:
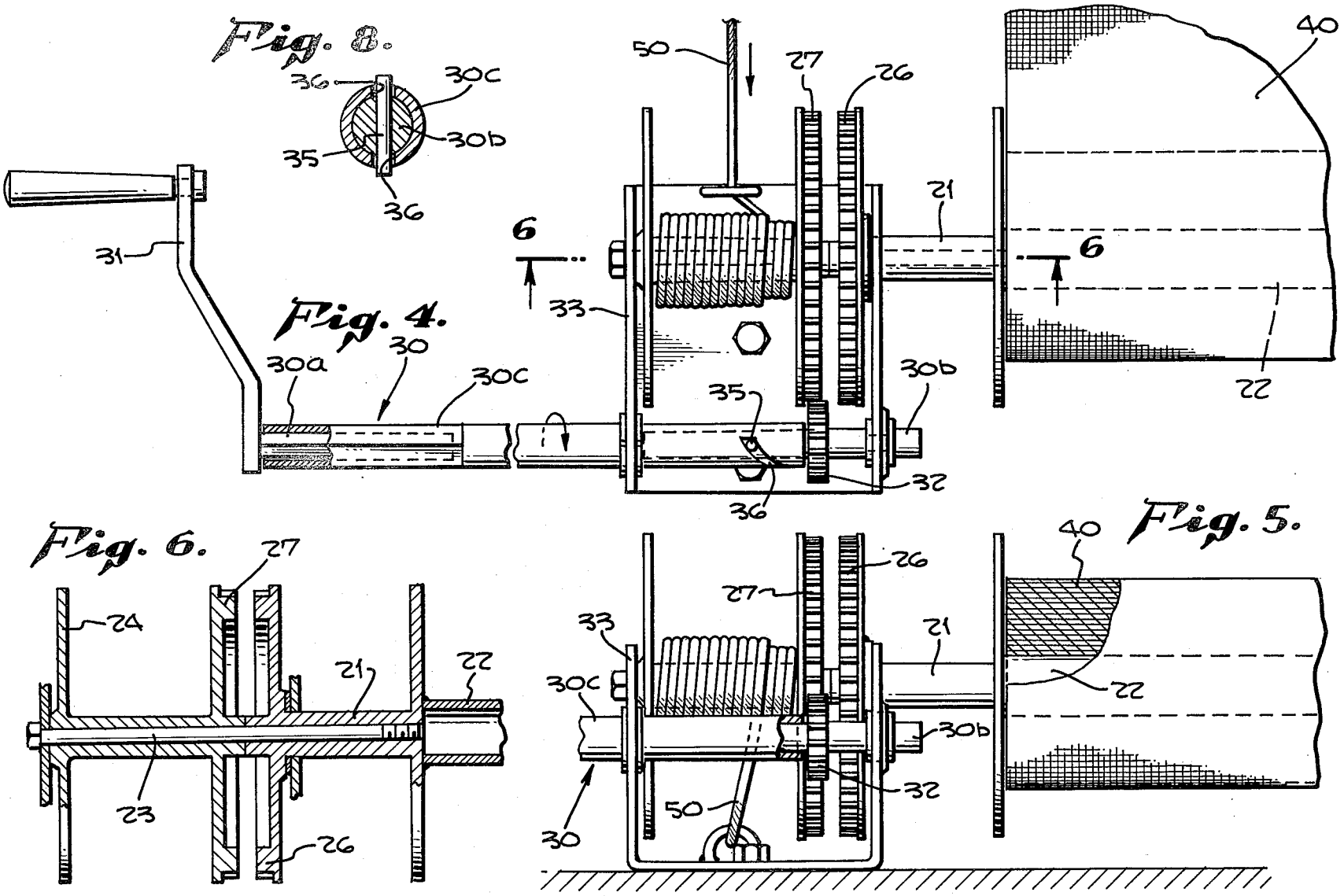
FIG. 4 is a top plan view of the hand crank, rope spool, and accompanying gear drive mechanisms when the cover is being extended over the pool.
FIG. 5 is an end elevation view of the rope spool, auxiliary drive shaft, and adjacent end of the cover drum.
FIG. 6 is a cross-sectional elevation view of the rope spool taken on Line 6—6 of FIG. 4 and showing its internal construction.
FIG. 8 is a cross-sectional view of the auxiliary drive shaft showing the internal construction of its camming mechanism.

A drum 22 is contained within the cover housing 20 (see FIG. 6). The purpose of drum 22 is to have removable cover sheet 40 wound upon it. One end 41 of the cover sheet, not specifically seen in the drawings, is attached to the drum 22. The free forward end 42 of the cover sheet is then available for extension lengthwise of the pool, as best seen in FIG. 1. The forward end of the cover sheet is turned over and hemmed so as to receive a rigid axle 45, shown only in dotted lines in FIG. 1. Wheels 46 and 47 are connected to respective ends of the axle 45, and these wheels roll along the decking on respective sides of the pool when the cover sheet 40 is being extended.

The drum 22 is supported on a main shaft 21 and is permanently affixed to the shaft. See FIGS. 4 through 7, inclusive. A gear wheel 26 is also permanently affixed to the main shaft 21 and is considered to be, in an operational sense, a part of the drum assembly. Thus, when gear wheel 26 is driven in rotation, the drum 22 will rotate with it.

A rope 50 is used for the purpose of pulling the forward end 42 of the cover sheet 40 when it is being extended. In general, one end of the rope 50 is connected to the lateral center of the forward end 42 of the cover sheet. More specifically, however, as shown in FIG. 1 the rope end has two separate legs 51, 52 which form a V-shaped configuration, the legs being attached to the cover on respective sides of its lateral center. It will be understood that the attachment of the rope ends 51, 52 to the forward or leading edge of the cover sheet 40 does not interfere with the rotation of axle 45. Thus, rope 50 pulls the cover sheet in its extending movement, and axle 45 together with its wheels 46, 47 rotates so as to transport the forward end of the cover.

A pulley assembly 60 is located at the near end of the pool (as seen in FIG. 1) and removably secured upon the decking 15*b*. A curved pin 61 attached to the pulley frame is inserted into a slanted hole 62 in the decking. Pulley assembly 60 is positioned substantially at the lateral center of the near end of the pool. Another similar pulley assembly 61 is positioned at the corner of the pool, at its near end. Pulley assembly 61 is also removably supported by the pool decking. Rope 50 extends forwardly from the cover sheet 40, is threaded through the pulley assembly 60, making a right turn at that location, then extends to the pulley assembly 61 where it makes another right turn, and hence extends back to the far end of the pool as shown in FIG. 1.

The main shaft 21 has an extended portion 23 as best seen in FIG. 6. A spool 24 is rotatably supported upon this extended portion of the main shaft. A gear wheel 27 is fixedly attached to the spool 24 and is considered to be a part of the spool. Thus when gear wheel 27 is driven in rotation the spool rotates with it. The purpose of spool 24 is to take up the rope 50.

An auxiliary drive shaft 30 is positioned parallel to the main shaft 21, but displaced from it. The drive shaft 30 is shown in part in each of the drawing FIGS. 4, 5 and 7. One end of the drive shaft 30 projects outward from the cover housing 20 and has a hand crank 31 attached to it. A driving gear 32 is carried by the other end of the drive shaft 30.

A suitable housing 33, FIGS. 4, 5, and 7, is provided for rotatably supporting the various shafts. That is, the housing 33 provides suitable journal supports for the main shaft 21, the main shaft extension 23, and the auxiliary drive shaft 30. A camming means incorporated in the drive shaft 30 is effective to cause the drive gear 32 to engage either the gear wheel 26 for rotating the drum, or the gear wheel 27 for rotating the spool.

FIG. 4 shows the operation when the rope 50 is being wound upon the spool 24 so as to extend the cover sheet 40. Thus, the action of extending the cover is shown partly in FIG. 1 and partly in FIG. 4. During this operation the drive gear 32 carried by drive shaft 30 engages the gear wheel 27 of drum 24. FIG. 5 is an end elevational view of the gear mechanism during the same operation.

When the cover sheet is to be retracted the hand crank 31 is rotated in the opposite direction. This action is shown in FIG. 7. Drive gear 32 then engages gear wheel 26 that is part of the cover sheet take-up drum 22.

The camming mechanism incorporated in the auxiliary drive shaft 30 will now be described. The drive shaft 30 includes two inner parts 30*a*, 30*b* which are axially aligned but spaced apart. The inner part 30*a* is rigidly attached to hand crank 31. The inner part 30*b* carries drive gear 32. An outer part of sleeve 30*c* covers the greater portion of the length of both of the inner parts 30*a*, 30*b*, and also extends across the space between them. Sleeve 30*c* is fixedly attached to shaft inner part 30*a*, but shaft inner part 30*b* can slide longitudinally within the sleeve. A pin 35 extends transversely through the inner shaft part 30*b* and has both of its ends protruding beyond its outer surface. The sleeve or outer shaft 30*c* has a pair of helical grooves 36 formed in it. See FIGS. 4 and 7. The projecting ends of the pin 35 are received in respective ones of these grooves. See FIGS. 4, 7, and 8.

The action of the camming mechanism is as follows. Sleeve 30*c* is secured to the housing 33 (FIG. 7) so that it cannot move longitudinally relative to the housing. Rotation of hand crank 31 in one direction causes the pin 35 to move to one end of the grooves 36 as shown in FIG. 4. This movement is possible because shaft inner part 30*b* is free to slide longitudinally relative to the housing 33. Drive gear 32, being fixed to the shaft portion 30*b*, moves with it and therefore comes into engagement with the gear wheel 27 of the spool 24. Continued rotation of hand crank 31 then causes rope 50 to be taken up on the spool 24.

It will be noted that rope 50 is connected to spool 24 in a sense opposite to that in which the cover sheet 40 is connected to the drum 22. That is, rope 50 winds upon the bottom side of spool 24 while cover sheet 40 winds upon the top side of drum 22.

When the hand crank is rotated in the opposite direction, the shaft part 30*b* moves farther away from the shaft part 30*a* and assumes the position shown in FIG. 7. Drive gear 32 moves with it and then meshes with gear wheel 26 which drives the cover take-up drum 22.

When the cover is fully extended, the sides are then fastened down by means of removable side fasteners. FIG. 3 shows an example of such a side fastener 65. It is removably secured to an anchor on the pool decking.

SIDE FASTENER

(FIG. 3)

The idea of the side fastener is that it remains attached to the cover sheet and is removed with it.

Cover sheet 40 has a turned-over edge 55, FIG. 3, which is stitched back upon itself. A polyester rope 56 having a diameter of about one-quarter inch is captured inside the seam of the cover. Cut-outs 57 are spaced about every three and one-half feet along the sides and the free end of the cover sheet. At each cut-out location the rope 56 is exposed.

Side fastener 65 includes a plastic strap 66 having a fixed end 67 that is looped around rope 56, and a free end 68. Free end 68 provides a loop that is retained by plastic buckle 69.

An anchor assembly 70 includes a lead anchor 71 that is driven into a hole in the decking. A small semi-circular flat plate 72 has a central hole, not shown, through which a flat-head machine bolt 73 passes for securing plate 72 to anchor 71, and hence in a horizontal position on the surface of the decking. A D-ring 74 has its flat side received in an edge loop 75 of the plate 72. Thus, ring 74 can rest in a horizontal position on the decking, or can be pivoted to an upright position.

Plate 72 is made from a single piece of metal folded over upon itself, thus forming the edge loop 75, which is located on the straight edge of the semi-circular plate.

In operation, when the cover sheet 40 has been extended, each strap end 68 is looped through the associated D-ring 74, and then cinched up in the buckle 69.

When the cover sheet is retracted, D-ring 74 will lie flat upon the concrete, either surrounding the plate 72 and head of bolt 73, or turned outwardly from them. In either position, experience has shown that the anchors do not present a safety hazard to bare-footed swimmers, and further, that stepping on the anchors involves only a minor amount of discomfort.

MOTOR DRIVE

(FIG. 9)

Figure 9:
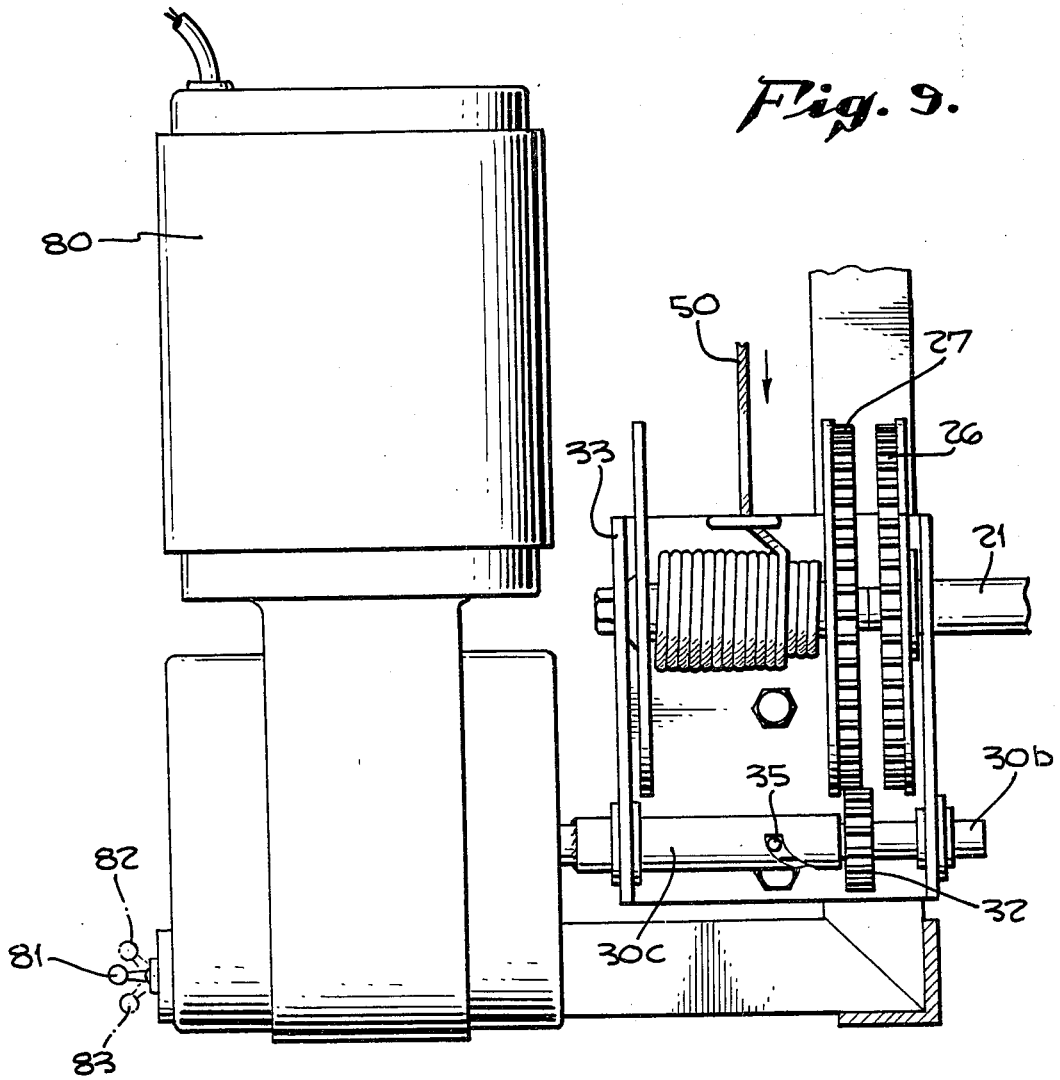
FIG. 9 is a view like FIG. 4 but showing an electric motor used as a power source in place of the hand crank.

FIG. 9 shows an electric motor 80 substituted for hand crank 31. A switch 81 has a forward position 82 for extending the cover and a reverse position 83 for retracting it. The remaining operations are as previously described.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. An easily extendible and retractable swimming pool cover assembly capable of being operated by a single person and comprising, in combination:

a cover sheet adapted to be horizontally extended from one end of a swimming pool to the other, and being of sufficient length and width to rest upon the decking surrounding the pool when the pool is covered;

a drum disposed above the pool decking adjacent to and generally parallel to said one end of the pool;

a main shaft rotatably supporting said drum;

a spool disposed adjacent one end of said drum at one side of the pool and supported for rotation about the axis of said main shaft but independently of said drum;

said cover sheet having one end secured upon said drum and its other end free for extension lengthwise of the pool;

a stiffening member carried by said other end of said cover sheet;

a plurality of side fasteners secured in spaced locations along the side edges and the free end of said cover sheet;

a rope whose length is more than double the length of the open top of the pool, one end of said rope being split into a V-shaped configuration providing two separate ends each of which is secured to said other end of said cover sheet on a respective side of the lateral center thereof;

the other end of said rope being secured upon said spool, said rope and cover sheet being respectively secured to said spool and drum in opposite rotational senses;

drive means selectively operable for driving either said drum or said spool so as to either retract or extend said cover sheet;

separate pulley means removably attached to the pool decking at substantially the lateral center of the other end of the pool, and at the far corner of the pool on the same side where said spool is located, respectively, so as to support said rope in a tensioned loop configuration; and a plurality of anchor means secured to the pool deck for cooperating with corresponding ones of said side fasteners;

the winding in of said cover on said drum being driven by the rotation of said drive means in one direction, while the winding in of said rope and paying out of said cover is driven by rotation of said drive means in the other direction;

said side fasteners being wound upon said drum with said cover sheet when in its retracted position.

2. A pool cover assembly as in claim 1 wherein said stiffener member is a shaft rotatably carried within said other end of said cover member and having wheels on its respective ends.

* * * * *